US009044870B2

(12) United States Patent
Yeh et al.

(10) Patent No.: US 9,044,870 B2
(45) Date of Patent: Jun. 2, 2015

(54) DIVE KNIFE WITH TWO ELASTIC BUCKLES AT TWO LATERAL SIDES

(71) Applicants: Hsiang-Li Yeh, Taipei (TW); Ching-chang Yeh, Taipei (TW)

(72) Inventors: Hsiang-Li Yeh, Taipei (TW); Ching-chang Yeh, Taipei (TW)

( * ) Notice: Subject to any disclaimer, the term of this patent is extended or adjusted under 35 U.S.C. 154(b) by 113 days.

(21) Appl. No.: 13/972,936

(22) Filed: Aug. 22, 2013

(65) Prior Publication Data

US 2015/0052759 A1 Feb. 26, 2015

(51) Int. Cl.
*B26B 29/02* (2006.01)

(52) U.S. Cl.
CPC ..... *B26B 29/025* (2013.01)

(58) Field of Classification Search
CPC ..... B26B 29/00; B26B 29/02; B26B 29/025; B26B 3/00; B26B 3/06; B26B 5/00; B26B 5/001
USPC ..... 30/342, 340, 151, 164, 286, 289, 296.1, 30/298, 329, 337
See application file for complete search history.

(56) References Cited

U.S. PATENT DOCUMENTS

| | | | | | |
|---|---|---|---|---|---|
| 5,123,167 | A * | 6/1992 | Kelley | 30/151 |
| 5,315,761 | A * | 5/1994 | Norton et al. | 30/162 |
| 5,794,347 | A * | 8/1998 | Serpa | 30/162 |
| 5,915,793 | A * | 6/1999 | Serpa | 30/162 |
| 5,926,959 | A * | 7/1999 | Collins | 30/162 |
| 6,138,363 | A * | 10/2000 | Kawashima | 30/151 |
| 7,080,456 | B2 * | 7/2006 | Wu | 30/151 |

* cited by examiner

*Primary Examiner* — Phong Nguyen

(57) ABSTRACT

A dive knife with two elastic buckles at two lateral sides includes a handle having a long groove therein; a buckle; each of a right side and a left side of the buckle having an upward elastic key; each elastic key extending upwards and being biforked at an upper end thereof so as to form with two claws; one claw near the body being as a hooking claw and another claw far away from the body being as a press key; a knife; a retaining set installed to the inner side of the rear cover; a front end of each left and right side of the lower retainer is extended with an elastic hook; and wherein in assembly, the buckle is received into the groove of the handle, the elastic hook will hook with the hooking claw of the elastic key of the buckle.

5 Claims, 6 Drawing Sheets

DIVE KNIFE WITH TWO ELASTIC BUCKLES AT TWO LATERAL SIDES

FIELD OF THE INVENTION

The present invention relates to dive knives, and in particular to a dive knife with two elastic buckles at two lateral sides.

BACKGROUND OF THE INVENTION

A prior art dive knife has a handle which has an oblong shape and a long recess is formed in the handle. A knife has one end received into the handle and another end thereof is inserted into a cover. The cover is mainly formed by a front cover and a rear cover. The front cover is engaged to the rear cover so as to form as a tightly engaged structure. A lower side of the cover is formed as an opening for receiving the knife. A lower side of the knife is buckled to the cover.

To be safely carried by people, a front end of the knife set has a buckling set. By pressing the buckling set, the knife will release from the cover so that the knife can be taken out from the cover.

However, this prior art structure has only one buckling set which is at a front side of the cover. When sinking into water, since the operation environment is very bad, the buckling set is possible to be pressed by mistake so that the knife will release from the cover to lose in water or even to hurt the diver.

SUMMARY OF THE INVENTION

Therefore, the object of the present invention is to resolve the above mentioned problem in prior art, the present invention provides a dive knife with two elastic buckles at two lateral sides, wherein since the two elastic keys are at two lateral side of the handle, the knife will not be taken out by mistake. Therefore, the present invention has a safe structure.

To achieve above object, the present invention provides a dive knife with two elastic buckles at two lateral sides, comprising: a handle having a long groove therein, a cross section of the handle has an oblong shape with two long sides and two short sides; a buckle having a main body; each of a right side and a left side of the body having an upward elastic key; a center of the body being formed with a long hollow penetrating hole; each elastic key extending upwards and being biforked at an upper end thereof so as to form with two claws; one claw near the body being as a hooking claw and another claw far away from the body being as a press key; a knife having one end inserted into the penetrating hole of the buckle; a cover including a front cover and a rear cover which are engagable to form as a cover; an inner side of the rear cover is formed with engaging holes and the front cover is formed with engaging posts; a retaining set installed to the inner side of the rear cover; the retaining set being formed by an upper retainer and a lower retainer; the lower retainer having a U-like structure so that when the upper retainer is assembled to the lower retainer, a space is formed therebetween; and a front end of each left and right side of the lower retainer is extended with an elastic hook; and wherein in assembly, the front cover is engaged to the rear cover to form as a cover; and the upper retainer is engaged to the lower retainer, while the receiving space is formed between the upper retainer and the lower retainer; and wherein in assembly, the buckle is received into the groove of the handle, while the flange of the body of the buckle resists against the groove of the handle; then, a lower end of the knife is received into a long hollow penetrating hole of the buckle; then the cover will cover the upper side of the knife; the cover continuously moves towards the buckle so that the knife enters into the space of the retainer set; next, the elastic hook of the retainer set will move into the space between the hooking claw and the press key; finally, the elastic hook will hook with the hooking claw of the elastic key of the buckle.

DETAILED DESCRIPTION OF THE PREFERRED EMBODIMENTS

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
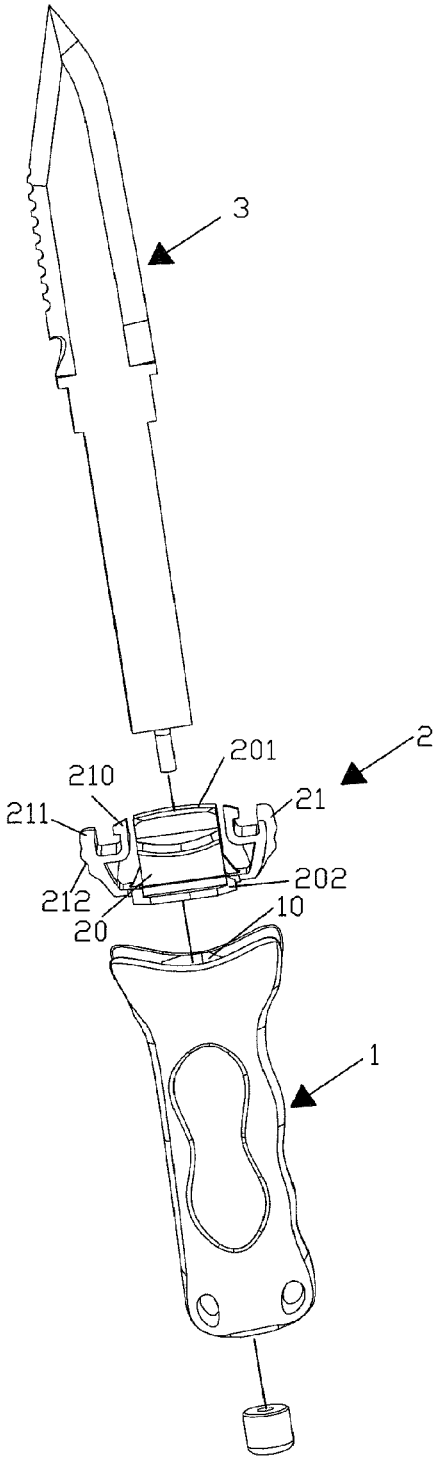
FIG. 1 is an exploded perspective view about the handle and knife of the present invention.
Figure 2:
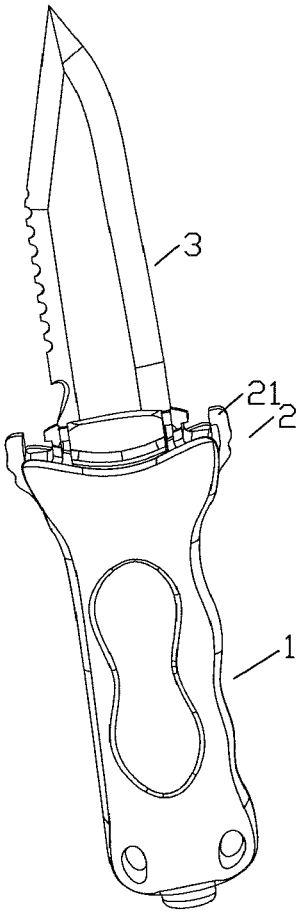
FIG. 2 is an assembly view about the knife and the handle of the present invention.
Figure 3:
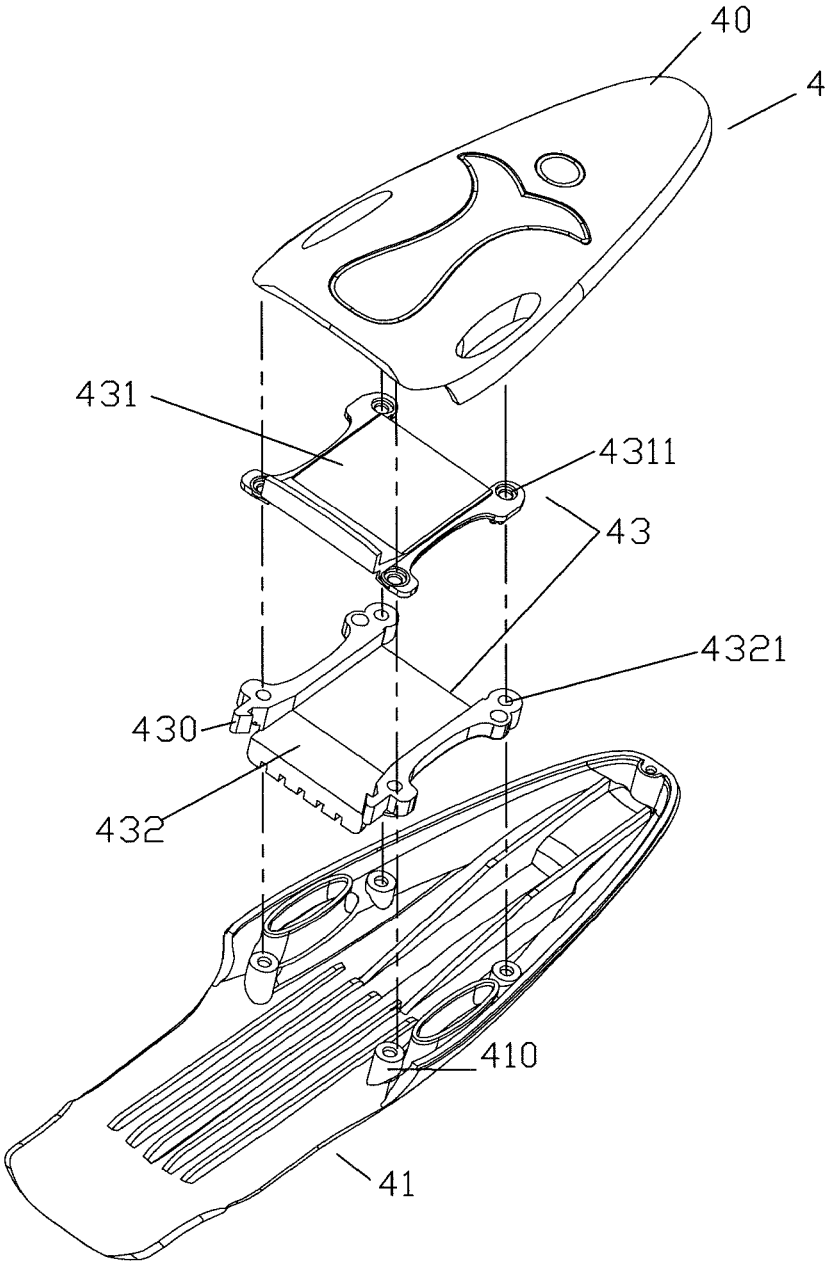
FIG. 3 is an exploded view about the cover of the present invention.

With reference to FIGS. 1 to 3, the structure of the present invention is illustrated. The present invention includes the following elements:

A handle 1 has a long groove therein. A cross section of the handle has an oblong shape with two long sides and two short sides. The handle 1 has a shape suitable for being held by people.

A buckle 2 has a body 20. Each of a right side and a left side of the body 20 has an upward elastic key 21.

A center of the body 20 is formed with a long hollow penetrating hole 201. A lower periphery of the body 20 is formed with a flange 202. The structure of the flange 202 is corresponding to the long groove 10 of the handle 1 so that the flange 202 can resist against the groove 10 of the handle 1 as the buckle 2 is received into the groove 10. Thus, the buckle 2 can be tightly buckled in the groove 10 of the handle 1.

The elastic keys 21 are integral formed with the body 20 of the buckle 2. Each elastic key 21 extends upwards and is biforked at an upper end thereof so as to form as two claws. One hooking claw 210 near the body 20 is as a hook and another claw 211 far away from the body 20 is as a press key 211. An outer side of the press key 211 is formed as a slide-proof block 212. The function of the slide-proof block 212 is to slide-proof for a finger pressing the press key 211.

A knife 3 has one end inserted into the penetrating hole 201 of the buckle 2.

Figure 8:
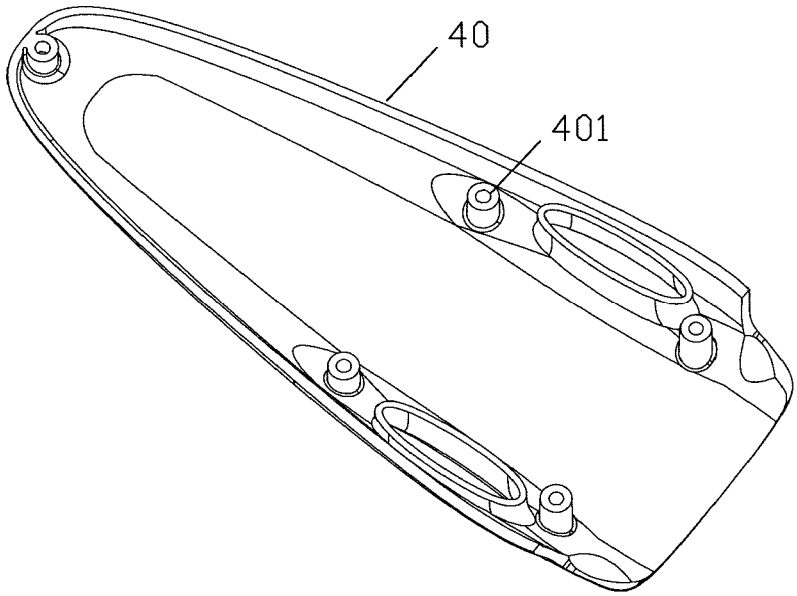
FIG. 8 is a perspective view showing a lower side of the upper cover of the present invention.

A cover 4 (referring to FIG. 3) includes a front cover 40 and a rear cover 41. A front cover 40 is recessed. The rear cover 41 is a plane or is also recessed. The front cover 40 and the rear cover 41 are engaged to form a complete cover 4. An inner side of the rear cover 41 is formed with engaging holes 410 and the front cover 40 is formed with engaging posts 401 (referring to FIG. 8).

A retaining set 43 is installed to the inner side of the rear cover 41. The retaining set 43 is formed by an upper retainer 431 and the lower retainer 432. The lower retainer 432 has a U-like structure so that when the upper retainer 431 is assembled to the lower retainer 432, a space 400 is formed therebetween. Four comers of the upper retainer 431 are formed with through holes 4311 and four corners of the lower retainer 432 are formed through holes 4321.

Figure 4:
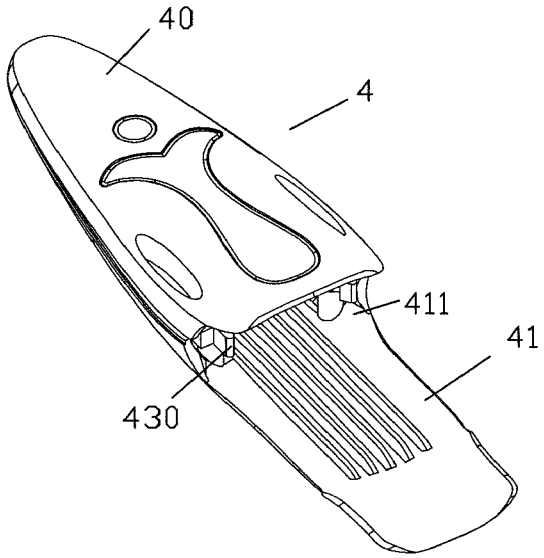
FIG. 4 is an assembled view about the cover of the present invention.
Figure 5:
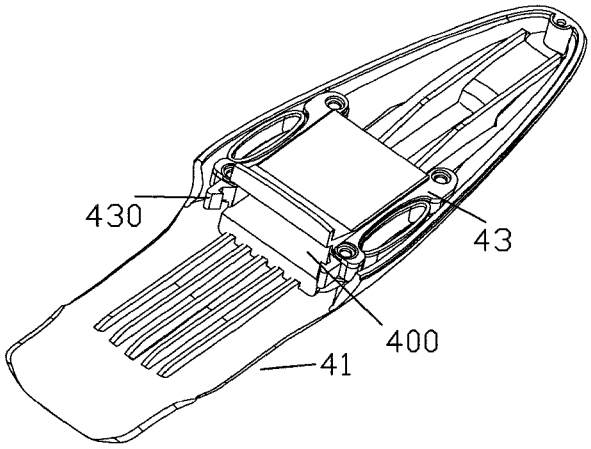
FIG. 5 is a perspective view showing the retainer set is assembled to the rear cover according to the present invention.

In assembly, referring to FIGS. 4 and 5, the engaging posts 401 of the front cover 40 pass through the through holes 4311 of the upper retainer 431 and the through holes 4321 of the lower retainer 432, and then through the engaging holes 410 of the rear cover 41 so that the front cover 40 is engaged to the rear cover 41 to form as a cover 4. Furthermore, the upper retainer 431 is engaged to the lower retainer 432, while a receiving space 400 is formed between the upper retainer 431 and the lower retainer 432.

A front end of each left and right side of the lower retainer 432 is extended with an elastic hook 430.

Figure 6:
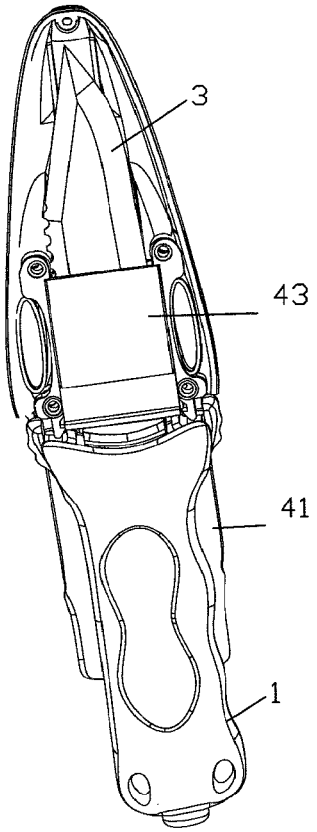
FIG. 6 is a partial assembled view showing that the knife is assembled to the handle and the cover of the present invention.
Figure 7:
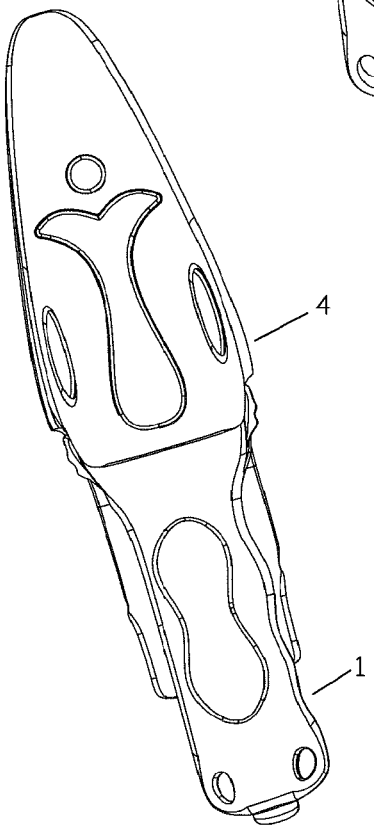
FIG. 7 shows the outlook of the present invention after the structure of the present invention is assembled.

In assembly the whole dive knife, referring to FIGS. 6 and 7, the buckle 2 is received into the groove 10 of the handle 1, while the flange 202 of the body 20 of the buckle 2 resists against the groove 10 of the handle 1. Then, a lower end of the knife 3 is received into a long hollow penetrating hole 201 of the buckle 1, as those illustrated in FIG. 2 of the present invention. Then the cover 4 will cover the upper side of the knife 3. The cover 4 continuously moves towards the buckle 2 so that the knife 3 enters into the space 400 of the retainer set 43. Next, the elastic hook 430 of the retainer set 43 will move into the space between the hooking claw 210 and the press key 211. Finally, the elastic hook 430 will hook with the hooking claw 210 of the elastic key 21 of the buckle 2.

If it is needed to take the cover 4 from the knife 3, it is only necessary to press the two press keys 211 simultaneously so that the elastic key 21 will move inward and thus the hooking claw 210 will release from the elastic hook 430. Thus, the cover 4 is released from the buckle 2 and then the cover 4 can be taken away from the buckle 2.

Advantage of the present invention is that since the two elastic keys 21 are at two lateral side of the handle 1, the two press keys 211 are pressed simultaneously. Thus the knife 3 will not be taken out by mistake. Therefore, the present invention has a safe structure.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A dive knife with two elastic buckles at two lateral sides, comprising:

a handle having a long groove therein, a cross section of the handle has an oblong shape with two long sides and two short sides;

a buckle having a main body; each of a right side and a left side of the body having an upward elastic key; a center of the body being formed with a long hollow penetrating hole;

each elastic key extending upwards and being biforked at an, upper end thereof so as to form with two claws; one claw near the body being as a hooking claw and another claw far away from the body being as a press key;

a knife having one end inserted into the penetrating hole of the buckle;

a cover including a front cover and a rear cover which are engagable to form as a cover; an inner side of the rear cover being formed with engaging holes and the front cover being formed with engaging posts;

a retaining set installed to the inner side of the rear cover; the retaining set being formed by an upper retainer and a lower retainer; the lower retainer having a U-like structure so that when the upper retainer is assembled to the lower retainer, a space is formed therebetween; and a front end of each left and right side of the lower retainer being extended with an elastic hook; and wherein in assembly, the front cover is engaged to the rear cover to form as a cover; and the upper retainer is engaged to the lower retainer, while the receiving space is formed between the upper retainer and the lower retainer; and wherein in assembly, the buckle is received into the groove of the handle; then, a lower end of the knife is received into a long hollow penetrating hole of the buckle; then the cover will cover the upper side of the knife; the cover continuously moves towards the buckle so that the knife enters into the space of the retainer set; next, the elastic hook of the retainer set will move into the space between the hooking claw and the press key; finally, the elastic hook will hook with the hooking claw of the elastic key of the buckle.

2. The dive knife with two elastic buckles at two lateral sides as claimed in claim 1, wherein the elastic keys are integral formed with the body of the buckle.

3. The dive knife with two elastic buckles at two lateral sides as claimed in claim 1, wherein an outer side of the press key is formed as a slide-proof block.

4. The dive knife with two elastic buckles at two lateral sides as claimed in claim 1, wherein an inner side of the rear cover is formed with engaging holes and the front cover is formed with engaging posts; four corners of the upper retainer are formed with through holes and four corners of the lower retainer are formed through holes;

wherein in assembly, the engaging posts of the front cover pass through the through holes of the upper retainer and the through holes of the lower retainer, and then through the engaging holes of the rear cover so that the front cover is engaged to the rear cover to form as a cover; furthermore, the upper retainer is engaged to the lower retainer, while a receiving space is formed between the upper retainer and the lower retainer.

5. The dive knife with two elastic buckles at two lateral sides as claimed in claim 1, wherein a lower periphery of the body is formed with a flange with a shape being corresponding to the groove of the handle so that the flange can resist against the groove of the handle as the buckle is received in the groove of the handle; and wherein in assembly, the buckle is received into the groove of the handle, while the flange of the body of the buckle resists against the groove of the handle.

* * * * *